US011212616B2

(12) United States Patent
Kim et al.

(10) Patent No.: US 11,212,616 B2
(45) Date of Patent: Dec. 28, 2021

(54) BONDING STRUCTURE OF DIAPHRAGM FOR RECEIVER

(71) Applicant: EM-TECH Co., Ltd., Gyeongsangnam-do (KR)

(72) Inventors: Ji Hoon Kim, Gyeongsangnam-do (KR); Young Woo Kim, Gyeongsangnam-do (KR); Yong Ju Ji, Gyeongsangnam-do (KR); Young Seok Noh, Gyeongsangnam-do (KR); Chan Ho Jeong, Gyeongsangnam-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 17/081,139

(22) Filed: Oct. 27, 2020

(65) Prior Publication Data

US 2021/0127209 A1 Apr. 29, 2021

(30) Foreign Application Priority Data

Oct. 29, 2019 (KR) ..... 10-2019-0135313

(51) Int. Cl.

| | |
|---|---|
| ***H04R 7/18*** | (2006.01) |
| ***H04R 7/12*** | (2006.01) |
| ***H04R 31/00*** | (2006.01) |

(52) U.S. Cl.

CPC ..... *H04R 7/18* (2013.01); *H04R 7/127* (2013.01); *H04R 31/003* (2013.01); *H04R 2307/025* (2013.01)

(58) Field of Classification Search

CPC ..... H04R 7/18; H04R 7/127; H04R 31/003; H04R 2307/025

See application file for complete search history.

(56) References Cited

U.S. PATENT DOCUMENTS 8,442,259 B2 * 5/2013 Williamson ..... H04R 7/20 381/398

FOREIGN PATENT DOCUMENTS

| | | | | |
|---|---|---|---|---|
| CN | 101783992 | A | 7/2010 | |
| CN | 202873037 | U | 4/2013 | |
| CN | 104703100 | A | 6/2015 | |
| CN | 105792078 | A | 7/2016 | |
| CN | 207053772 | U | 2/2018 | |
| EP | 2709381 | A2 | 3/2014 | |
| KR | 20060022867 | A * | 3/2006 | |
| KR | 100834075 | B1 | 6/2008 | |
| KR | 101489765 | B1 | 2/2015 | |
| KR | 101502379 | B1 | 3/2015 | |
| KR | 101622155 | B1 | 5/2016 | |
| WO | WO-2008030026 | A1 * | 3/2008 | ..... H04R 7/125 |

* cited by examiner

*Primary Examiner* — Sunita Joshi

(74) *Attorney, Agent, or Firm* — Murphy, Bilak & Homiller, PLLC

(57) ABSTRACT

Disclosed is a bonding structure of a diaphragm for a receiver and a method thereof. The diaphragm of the receiver includes a center diaphragm and a side diaphragm elastically supporting the center diaphragm, formed by heat and pneumatic pressure, and bonded to the center diaphragm. At least one of the center diaphragm and the side diaphragm is formed of a thermoplastic elastomer film.

6 Claims, 5 Drawing Sheets

BONDING STRUCTURE OF DIAPHRAGM FOR RECEIVER

TECHNICAL FIELD

The present disclosure relates to a bonding structure of a diaphragm for a receiver.

BACKGROUND

Receivers mounted on small devices such as mobile devices to generate sound largely use diaphragms which are divided to be formed as two or more pieces including a center diaphragm and a protruding edge and then bonded to each other to reproduce sound by making the most of characteristics of lower and upper registers.

FIG. 1 is a cross-sectional view showing bonding of a diaphragm of a receiver according to the related art.

The diaphragm of the receiver according to the related art includes a center diaphragm 10 forming a central portion and a side diaphragm 20 having an inner side and an outer side bonded to the center diaphragm 10 and a frame (not shown), respectively, to support the center diaphragm 10 and generating sound having a range different from that of the center diaphragm 10.

Here, the center diaphragm 10 and the side diaphragm 20 are adhered to each other by an adhesive 40 such as a UV curing bond. However, a weight of a vibration system exerts a huge influence on performance of the receiver, acoustic characteristics of the receiver may vary depending on the amount of bond used at the time of adhesion. In addition, there is a high possibility of defects that occur due to a bond during a manufacturing process, such as leakage of the adhesive or non-uniform application thereof.

FIG. 2 is a cross-sectional view showing bonding of a diaphragm of a receiver according to another related art.

According to another related art, a diaphragm may expand an effective area of a center diaphragm to improve acoustic characteristics. The center diaphragm includes a dome part 11 protruding upward, a flat seating portion 12 allowing a voice coil 30 to be bonded thereto, and an extending portion 13 extending outward from the seating portion 12.

The side diaphragm includes an inner end 21 overlapping the dome part 11 of the center diaphragm, a seating portion 22 overlapping the seating portion 12 of the center diaphragm, a bridge 23 overlapping the extending portion 13 of the center diaphragm, a dome-shaped edge 24 protruding to elastically support the center diaphragm, and an outer end 25 to be attached to a frame (not shown).

In the related art, since the side diaphragm and the center diaphragm are bonded to each other by an adhesive such as a bond, the extending portion 13 of the center diaphragm may be attached only to the flat-shaped bridge 23 so that the bond may not interfere with vibration of the edge 24. That is, the effective area of the center diaphragm is generally up to the seating portion 22 and may extend only up to the bridge 23, if the effective area is intended to be maximized. Accordingly, an area to which the extending portion 13 of the center diaphragm may extend is limited.

SUMMARY

Therefore, an object of the present disclosure is to provide an improved bonding structure of a diaphragm for a receiver and a bonding method capable of improving the bonding structure of a diaphragm for a receiver.

According to an aspect of the present disclosure, there is provided a bonding structure of a diaphragm for a receiver, including: a center diaphragm provided at a central portion of a diaphragm; a side diaphragm bonded to one of upper and lower surfaces of the center diaphragm to elastically support the center diaphragm; a flat seating end provided at the center diaphragm and the side diaphragm to allow a voice coil to be bonded thereto; and an extending portion of the center diaphragm extending to an outer side of the seating end, wherein the side diaphragm is thermally compressed and bonded to the seating end and the extending portion of the center diaphragm simultaneously when formed by heat and pneumatic pressure.

In addition, as another example of the present disclosure, the center diaphragm may have a dome part at the center thereof, and the side diaphragm may be thermally compressed and bonded to the dome part, the seating end, and the extending portion of the center diaphragm simultaneously when formed by heat and pneumatic pressure.

In addition, as another example of the present disclosure, the side diaphragm may include an outer end seated on a frame and a dome-shaped edge connecting the seating end and the outer end, and the extending portion of the center diaphragm is thermally compressed and bonded with the edge of the side diaphragm.

In addition, as another example of the present disclosure, at least one of the center diaphragm and the side diaphragm may be formed of a thermoplastic elastomer film.

As another example of the present disclosure, the thermoplastic elastomer may be thermoplastic polyurethane (TPU) or high density polyethylene (HDPE).

The bonding structure of a diaphragm for a receiver and the bonding method provided by the present disclosure may reduce a weight of a vibration system by removing a bond, thereby improving acoustic characteristics.

The bonding structure of a diaphragm for a receiver and the bonding method provided by the present disclosure may prevent defects due to leakage or non-uniform application of an adhesive by bonding the center diaphragm and the side diaphragm through thermal compression.

In addition, the bonding structure of a diaphragm for a receiver and the bonding method provided by the present disclosure may reduce a manufacturing process by forming the side diaphragm simultaneously when the center diaphragm and the side diaphragm are bonded through thermal compression.

DETAILED DESCRIPTION

Hereinafter, the present disclosure will be described in more detail with reference to the drawings.

Figure 1:
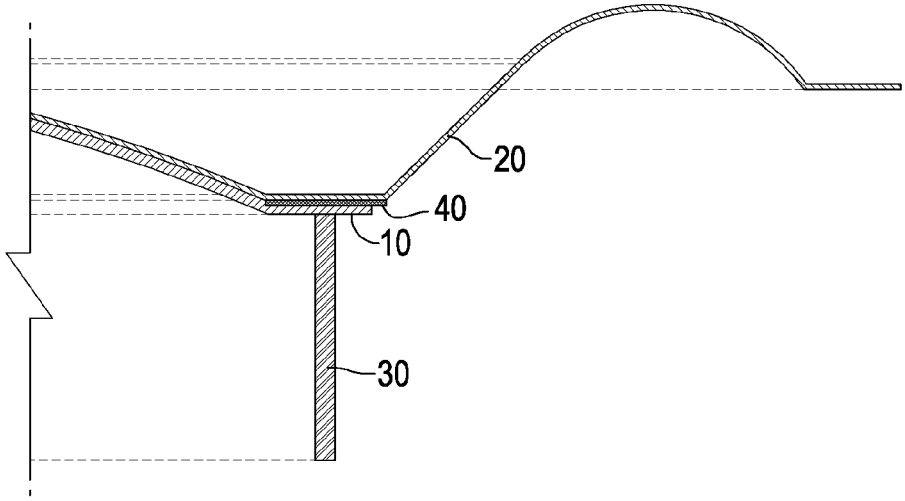
FIG. 1 is a cross-sectional view showing bonding of a diaphragm of a receiver according to the related art.
Figure 2:
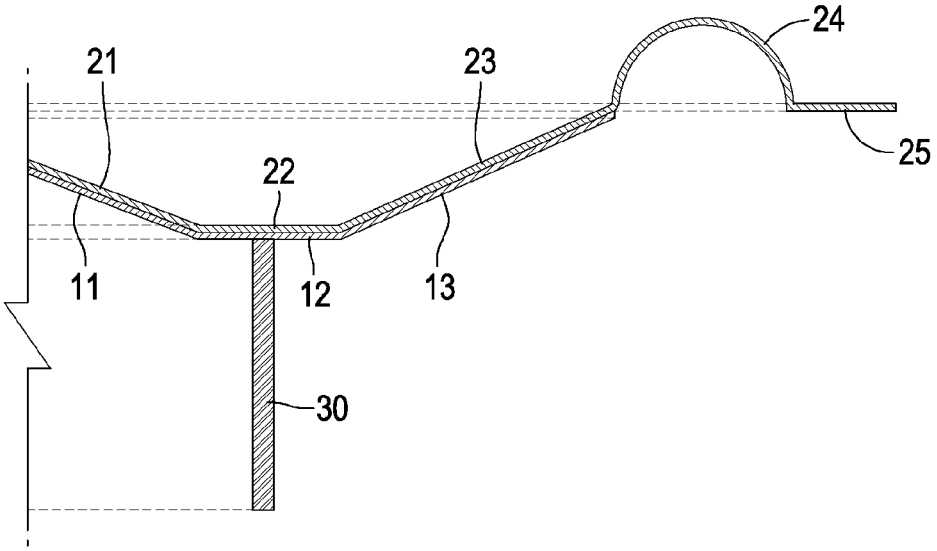
FIG. 2 is a cross-sectional view showing bonding of a diaphragm of a receiver according to another related art.
Figure 3:
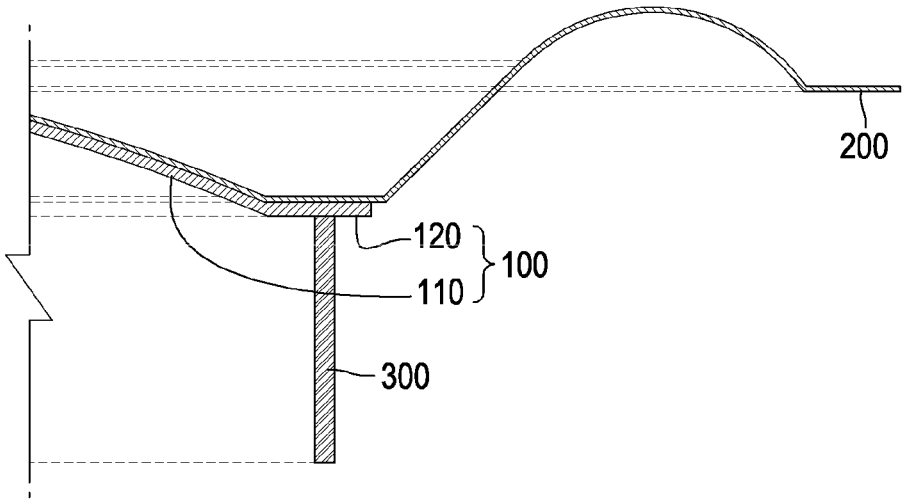
FIG. 3 is a view showing a part of a cross-section of a diaphragm of a receiver according to a first embodiment of the present disclosure.
Figure 4:
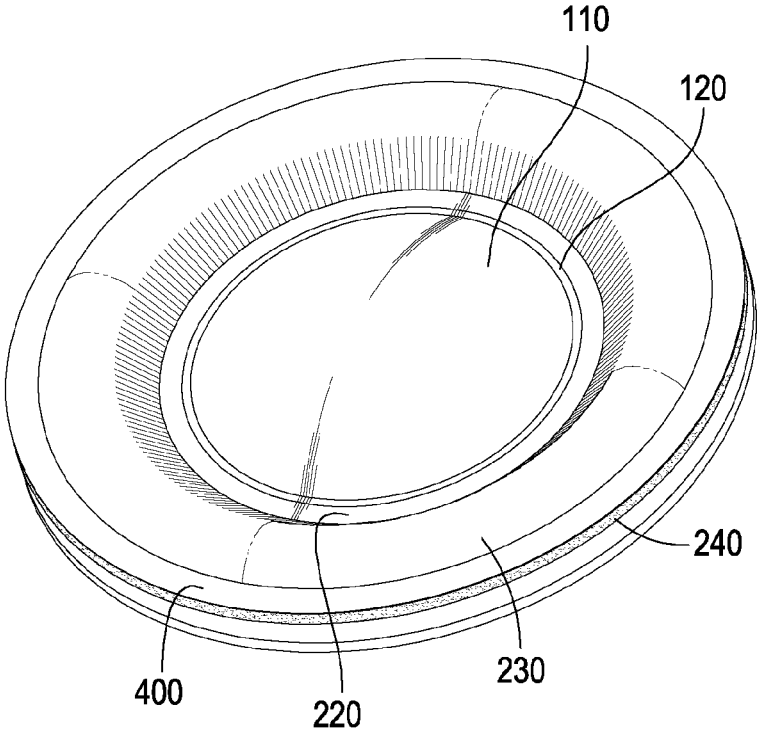
FIG. 4 is a perspective view of a diaphragm of a receiver according to the first embodiment of the present disclosure.

FIG. 3 is a view showing a part of a cross-section of a diaphragm of a receiver according to a first embodiment of the present disclosure, and FIG. 4 is a perspective view of the diaphragm of the receiver according to the first embodiment of the present disclosure.

A diaphragm of the receiver according to the first embodiment of the present disclosure is formed by bonding a center diaphragm 100 and a side diaphragm 200 through thermo-compression by heat and pneumatic pressure.

The center diaphragm 100 has a dome shape protruding upward and includes a dome part 110 and a flat seating end 120 on an outer circumference of the dome part 110. The seating end 120 has a shape provided for bonding a voice coil 300.

The side diaphragm 200 includes an inner end 210 thermally compressed and bonded with the dome part 110 of the center diaphragm 100, a seating end 220 thermally compressed and bonded with the seating end 120 of the center diaphragm 100, an edge 230 formed on an outer circumference of the seating end 220 and having a dome shape to elastically support the center diaphragm 100, and an outer end 240 seated on a frame (not shown) of the receiver.

A guide ring 400 formed of a hard material such as metal or high-strength plastic rather than a flexible film material such as the center diaphragm 100 or the side diaphragm 200 may be bonded to the outer end 240 to facilitate assembly. Since the outer end 240 of the side diaphragm 200 is fixed to the frame and does not vibrate, a weight of a vibration system does not change even if the guide ring 400 is bonded to the outer end 240 of the side diaphragm 200.

The center diaphragm 100 and the side diaphragm 200 are sequentially seated on a mold, and when the mold is heated, the center diaphragm 100 and the side diaphragm 200 are simultaneously thermally compressed by a high pneumatic pressure applied toward the mold.

Here, the shapes of the inner end 210, the seating end 220, the edge 230, and the outer end 240 of the side diaphragm 200 are formed simultaneously when thermal compression is performed. Therefore, the side diaphragm 200 is preferably a thermoplastic material, and, in particular, a thermoplastic elastomer film material. As a thermoplastic synthetic resin, a thermoplastic polyurethane (TPU) elastomer or high density polyethylene (HDPE) may also be used.

Meanwhile, the center diaphragm 100, as well as the side diaphragm 200, may be a thermoplastic resin. Here, adhesive force between the center diaphragm 100 and the side diaphragm 200 may be strengthened compared to the case where only the side diaphragm 200 is a thermoplastic resin.

By bonding the center diaphragm 100 and the side diaphragm 200 to each other by heat and pneumatic pressure without using an adhesive, there is an advantage in that defects caused by the adhesive may be improved and manufacturing variations may be reduced.

In addition, since forming of the side diaphragm 200 and bonding with the center diaphragm 100 are simultaneously performed, a process time may be reduced.

Figure 5:
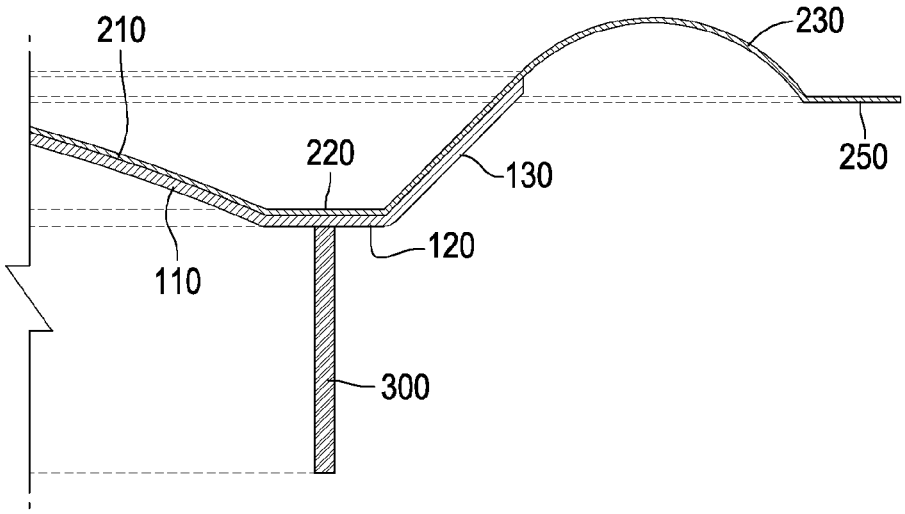
FIG. 5 is a view showing a part of a cross-section of a diaphragm of a receiver according to a second embodiment of the present disclosure.

FIG. 5 is a view showing a part of a cross-section of a diaphragm of a receiver according to a second embodiment of the present disclosure.

The center diaphragm has a dome shape protruding upward and includes a dome part 110 and a flat seating end 120 on an outer circumference of the dome part 110. The seating end 120 has a shape provided for attaching a voice coil 300. Here, the center diaphragm according to the second embodiment of the present disclosure further includes an extending portion 130 further extending to an outer circumference of the seating end 120. The extending portion 130 is thermally compressed and bonded with the edge 230 of the side diaphragm.

As in the first embodiment, the side diaphragm includes the inner end 210 thermally compressed and bonded with the dome part 110 of the center diaphragm 100, the seating end 220 thermally compressed and bonded with the seating end 120 of the center diaphragm 100, the edge 230 formed on an outer circumference of the seating end 220 and having a dome shape to elastically support the center diaphragm 100, and the outer end 240 seated on a frame (not shown) of the receiver.

The extending portion 130 of the center diaphragm has an advantage of increasing the area of thermal compression with the side diaphragm and increasing an effective diaphragm area of the center diaphragm, thereby improving adhesion strength and acoustic frequency characteristics.

In addition, in the side diaphragm, unlike the related art, the edge 230 is formed outside the seating end 220 and the edge 230 and the extending portion 130 are compressed, rather than using a separate bridge for bonding the extending portion 130 of the center diaphragm, whereby an extended area of the extending portion 130 is not significantly limited. That is, unlike the related art, the extending portion 130 advantageously increases the area up to the edge 230 unlike the related art. In other words, the effective area of the center diaphragm may be extended to a larger range than in the related art. In addition, since the extending portion 130 of the center diaphragm is thermally compressed and bonded to the edge 230, tuning of the characteristics of the entire frequency band is facilitated.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A bonding structure of a diaphragm for a receiver, the bonding structure comprising:

a center diaphragm provided at a central portion of a diaphragm, having a dome part at a center thereof, a flat seating end provided at an outer side of the center dome part and an extending portion extending to an outer side of the flat seating end; and a side diaphragm thermally compressed and bonded to one of upper and lower surfaces of the dome part, the flat seating end and the extending portion of the center diaphragm simultaneously when formed by heat and pneumatic pressure to elastically support the center diaphragm, wherein the side diaphragm further includes an outer end seated on a frame and a dome-shaped edge connecting the flat seating end and the outer end;

wherein the flat seating end provided at the center diaphragm and the side diaphragm allow a voice coil to be bonded thereto; and wherein the extending portion of the center diaphragm extending to a part of the dome-shaped edge which is an outer side of the flat seating end of the side diaphragm.

2. The bonding structure of claim 1, wherein at least one of the center diaphragm and the side diaphragm is formed of a thermoplastic elastomer film.

3. The bonding structure of claim 2, wherein the thermoplastic elastomer is thermoplastic polyurethane (TPU) or high density polyethylene (HDPE).

4. A method of producing a bonding structure of a diaphragm for a receiver, the method comprising:

providing a center diaphragm at a central portion of a diaphragm, the center diaphragm having a dome part at a center thereof, a flat seating end provided at an outer side of the center dome part and an extending portion extending to an outer side of the flat seating end;

thermally compressing and bonding a side diaphragm to one of upper and lower surfaces of the dome part, the flat seating end and the extending portion of the center diaphragm simultaneously when formed by heat and pneumatic pressure to elastically support the center diaphragm, wherein the side diaphragm further includes an outer end seated on a frame and a dome-shaped edge connecting the flat seating end and the outer end;

wherein the flat seating end at the center diaphragm and the side diaphragm to allow a voice coil to be bonded thereto, wherein the extending portion of the center diaphragm extending to a part of the dome-shaped edge which is an outer side of the flat seating end of the side diaphragm.

5. The method of claim 4, wherein at least one of the center diaphragm and the side diaphragm is formed of a thermoplastic elastomer film.

6. The method of claim 5, wherein the thermoplastic elastomer is thermoplastic polyurethane (TPU) or high density polyethylene (HDPE).

* * * * *